US006679318B2

(12) United States Patent
Bakke

(10) Patent No.: US 6,679,318 B2
(45) Date of Patent: Jan. 20, 2004

(54) LIGHT WEIGHT RIGID FLAT HEAT PIPE UTILIZING COPPER FOIL CONTAINER LAMINATED TO HEAT TREATED ALUMINUM PLATES FOR STRUCTURAL STABILITY

(76) Inventor: Allan P Bakke, 3220 County View Ct. SW., Rochester, MN (US) 55902

( * ) Notice: Subject to any disclaimer, the term of this patent is extended or adjusted under 35 U.S.C. 154(b) by 0 days.

(21) Appl. No.: 10/294,318

(22) Filed: Nov. 14, 2002

(65) Prior Publication Data

US 2003/0136551 A1 Jul. 24, 2003

Related U.S. Application Data

(60) Provisional application No. 60/350,491, filed on Jan. 19, 2002.

(51) Int. Cl.[7] ..... F28D 15/00

(52) U.S. Cl. ..... 165/104.26; 165/104.33; 361/700; 174/15.2

(58) Field of Search ..... 165/104.26, 905, 165/104.33, 185; 361/700; 174/15.2

(56) References Cited

U.S. PATENT DOCUMENTS

| | | | | |
|---|---|---|---|---|
| 4,212,347 A | * | 7/1980 | Eastman | 165/46 |
| 5,560,423 A | * | 10/1996 | Larson et al. | 165/104.26 |
| 5,642,776 A | | 7/1997 | Meyer | |
| 6,392,883 B1 | | 5/2002 | Ali | |
| 6,446,706 B1 | * | 9/2002 | Rosenfeld et al. | 165/46 |

* cited by examiner

*Primary Examiner*—Terrell McKinnon

(57) ABSTRACT

A very thin flat plate shaped sintered copper powder wick with a waffle pattern on one surface is sealed between two sheets of thin copper foil. The interior space within the sealed foil is evacuated and charged with sufficient water to saturate the wick through a copper tube which is then hermetically sealed, producing the working core of a flat plate heat pipe. Heat treated aluminum plates are bonded with thin, thermally conductive adhesive layers to both the evaporator and condenser surfaces of the copper foil heat pipe container. The resulting flat heat pipe is lighter in weight by about 40%, much more durable, and less expensive to fabricate than all-copper, machined container flat plate heat pipes, while high performance is maintained.

14 Claims, 4 Drawing Sheets

LIGHT WEIGHT RIGID FLAT HEAT PIPE UTILIZING COPPER FOIL CONTAINER LAMINATED TO HEAT TREATED ALUMINUM PLATES FOR STRUCTURAL STABILITY

This application claims the benefit of provisional application No. 60/350,491, filed Jan 19, 2002.

BACKGROUND—FIELD OF THE INVENTION

Flat plate heat pipes or heat spreaders made of copper with sintered copper internal wicks and water as the working fluid are currently available. Copper-water is the best combination of container and working fluid for heat pipes in the temperature range 20 to 100 C. from a number of perspectives, including toxicity, flammability and performance.

A significant drawback of this copper-water combination is the weight of the heat pipe resulting from the high density of copper (0.34 lb/cubic inch), and its relatively low yield strength (about 10,000 psi). A heat pipe made of copper approximately 8 inches×12 inches×0.25 inch thick of necessity weighs about 3.5 lb.

I have invented a flat plate heat pipe with the benefits of the copper-water combination, which is significantly lighter (about 2 lb. for the size described above), while also being stronger and more durable and less expensive to produce.

My invention employs a copper foil internal container for compatibility with water and a heat treated aluminum outer plate surface to provide structural strength and resistance to puncture.

BACKGROUND—DESCRIPTION OF PRIOR ART

Flat copper-water heat pipes are currently produced by several methods. One approach is to arrange multiple traditional cylindrical heat pipes in a parallel array soldered to a flat plate. A second layer of heat pipes may be arranged perpendicular to the first layer to achieve high heat flow in all directions, resulting in an isothermal condensing surface.

Another method uses a machined copper container formed by a very shallow pan about 0.2 inch deep with a grid of closely spaced supports remaining after the pan has been machined from a 0.2 inch thick plate of copper. A copper powder wick is sintered into the pan and a fill tube is soldered or welded in place. A copper sheet covering the pan is then welded around the periphery of the resulting heat pipe container, which is checked for leaks before being charged with an appropriate amount of water and sealed by clamping the fill tube and then welding it to permanently hermetically seal the finished flat heat pipe.

The drawbacks of the above-described approaches are the relative vulnerability to external insults resulting when one attempts to achieve a light weight heat pipe. The large flat surfaces of the heat pipe, when made of copper, must be very thin to achieve a reasonably light weight. Internal supports (also solid copper) must be closely spaced to allow the thin copper walls of the heat pipe to support even the external atmospheric pressure (internal pressure of the heat pipe is very low). When this is done, the flat surfaces are quite fragile if bumped by a sharp object. Machining of the copper container pan with support posts requires significant time and cost.

U.S. Pat. No. 5,642,776 describes a very light weight heat pipe with a semi-rigid plastic foam wick. Its purpose is to provide a useful, if low efficiency, electrically insulated heat pipe. Its envelope container is comprised of a very thin and flexible film utilizing several layers of very thin foil and plastic film. No protective outer surface plates are used, rendering the heat pipe very vulnerable to failure by puncture. Also, the heat pipe's internal vacuum would cause its thin film envelope to partially collapse, significantly impairing performance by reducing its contact area with the object being cooled. It is, therefore, a low performance, puncture vulnerable and somewhat flexible device, whereas the current invention approaches the ultimate in flat heat pipe performance while reducing cost and weight in a very durable and puncture resistant rigid flat heat pipe.

U.S. Pat. No. 6,446,706 B1 describes a very flexible heat pipe which can be made in the form of a tape for application to objects to be cooled. This invention also uses a very thin and flexible multi-layer film as its envelope container, about 0.007 inch thick. Only 0.002 inch is made of very thin metal foil, in two layers of 0.001 inch. These foil layers are for gas leak protection only and do not offer any protection against puncture and the resulting heat pipe failure. There is not, nor could there be, any protective plate applied to the outside of the heat pipe for rigidity and puncture resistance, because this invention's purpose is to produce a very flexible heat pipe which may be applied as tape to irregular surfaces. The wick materials described are, of necessity, flexible. Only copper felt and fine screen are suggested. The separator materials which provide open vapor space within the heat pipe also need to be flexible, and only coarse screen and coarse copper felt are suggested. Because the flexibility criterion dictated the use of a mostly plastic film as the container, this heat pipe would be a lower performance, puncture prone, very flexible device, whereas the current invention approaches the ultimate in flat heat pipe performance while reducing cost and weight in a very durable and puncture resistant rigid flat heat pipe.

U.S. Pat. No. 6,392,883 describes a flat heat pipe but gives no specific guidance or performance information. The heat pipe discussed is a component of a multi-component heat dissipation system. No laminations or wick details are taught.

SUMMARY

A flat plate copper-water heat pipe employs thin copper foil for a container to avoid the large weight penalty of a machined copper container. A sintered copper powder wick with a waffle shaped grid molded into one face provides mechanical support of the foil container while the open space of the waffle grid allows free flow of steam to cool areas of the container surface for condensation heating. Thin heat treated aluminum plates are bonded to both the evaporator and condenser surfaces of the copper foil container with a very thin film of thermally conductive transfer tape, providing strength and durability while preserving high thermal performance.

OBJECTS AND ADVANTAGES

Accordingly, several objects and advantages of my invention are as follows. The weight of the copper-water heat pipe core is minimized by utilizing thin copper foil to make the container, and by making the sintered copper wick (covering the entire evaporator surface of the flat heat pipe) as thin as is practical.

The space between the wick and the condensing copper foil surface is kept partially open to steam flow, both perpendicularly to the flat plate surface and laterally, by any of several means. Three such means are 1) a grid molded into the sintered copper wick, 2) a copper screen, and 3) a flat sheet of rigid copper open cell foam. Any of these serve to allow free flow of steam to any cool area of the heat pipe condensing surface, keeping the condensing surface essentially isothermal even when the cooling load does not coincide with the heated area of the evaporator surface.

The heat pipe so constructed would not remain flat or be structurally stable and durable without the addition of other elements for strength, stability and durability. This invention answers this requirement by laminating a much lighter and stronger plate of heat treated aluminum to both faces of the flat heat pipe. The resulting completed flat heat pipe structure is reliably flat, much less fragile to damage by sharp objects, and most importantly weighs little more than half the weight of a similar all-copper flat plate heat pipe.

Still further objects and advantages will become apparent from a consideration of the ensuing description and accompanying drawings.

REFERENCE NUMERALS

Figure 1:
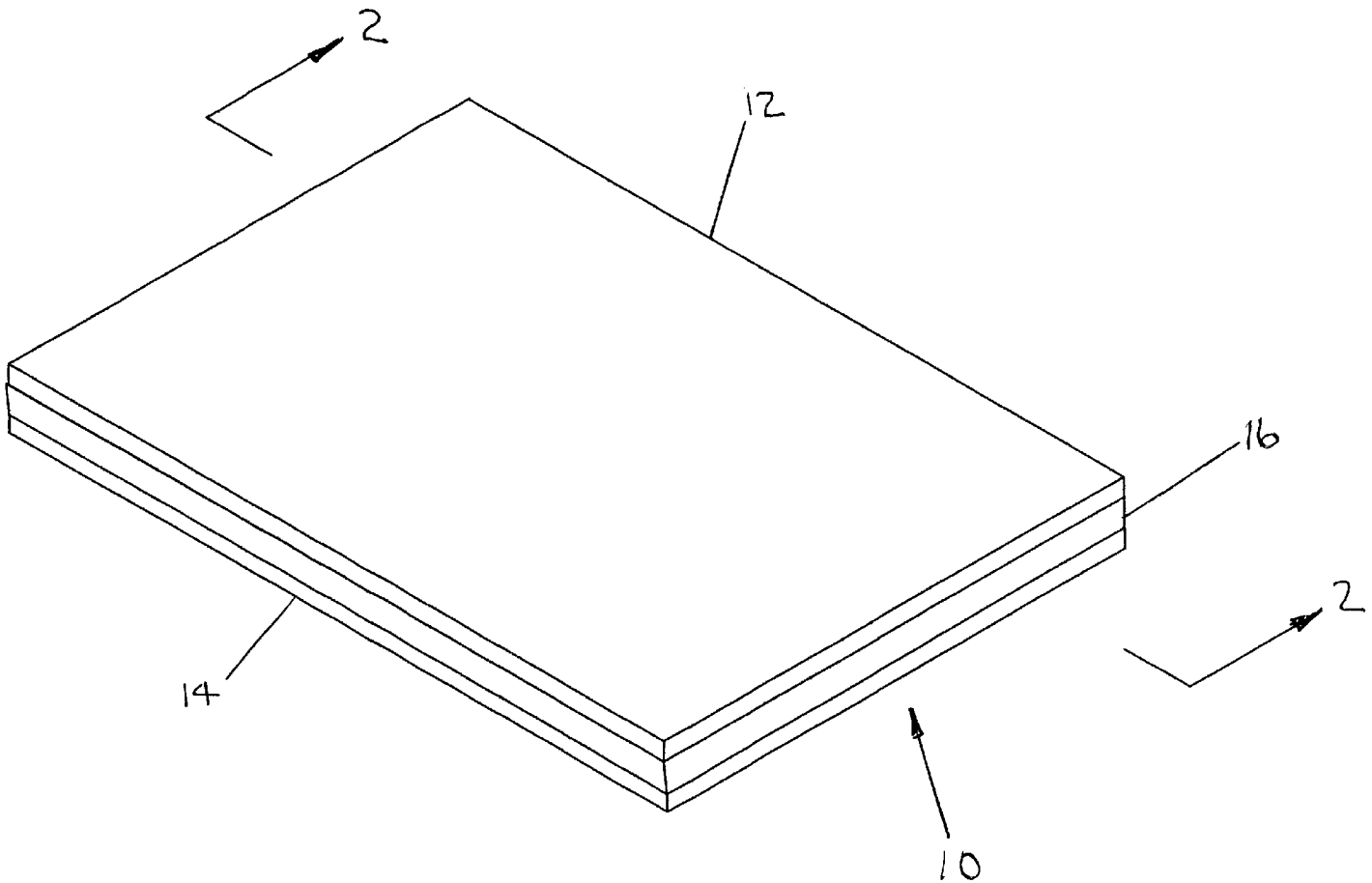
FIG. 1 is an isometric view of my invention.

10 flat plate heat pipe invention
12 condensing surface aluminum plate
14 evaporating surface aluminum plate
16 potting material
18 sintered copper powder waffle surface wick
20 copper foil sheet
22 copper foil pan
24 transfer tape
26 copper screen
28 flat sintered wick
30 rigid copper open cell foam sheet
32 hermetic seal

PREFERRED EMBODIMENT—DESCRIPTION

FIG. 1 shows the present flat plate heat pipe invention 10 with condensing surface aluminum plate 12. Evaporating surface aluminum plate 14 is on the underside of FIG. 1 and only two of its edges are shown in this view. Potting material 16 comprised of epoxy or other elastomeric material provides a smooth edge around the periphery of the laminated flat plate heat pipe invention 10.

Figure 2A:
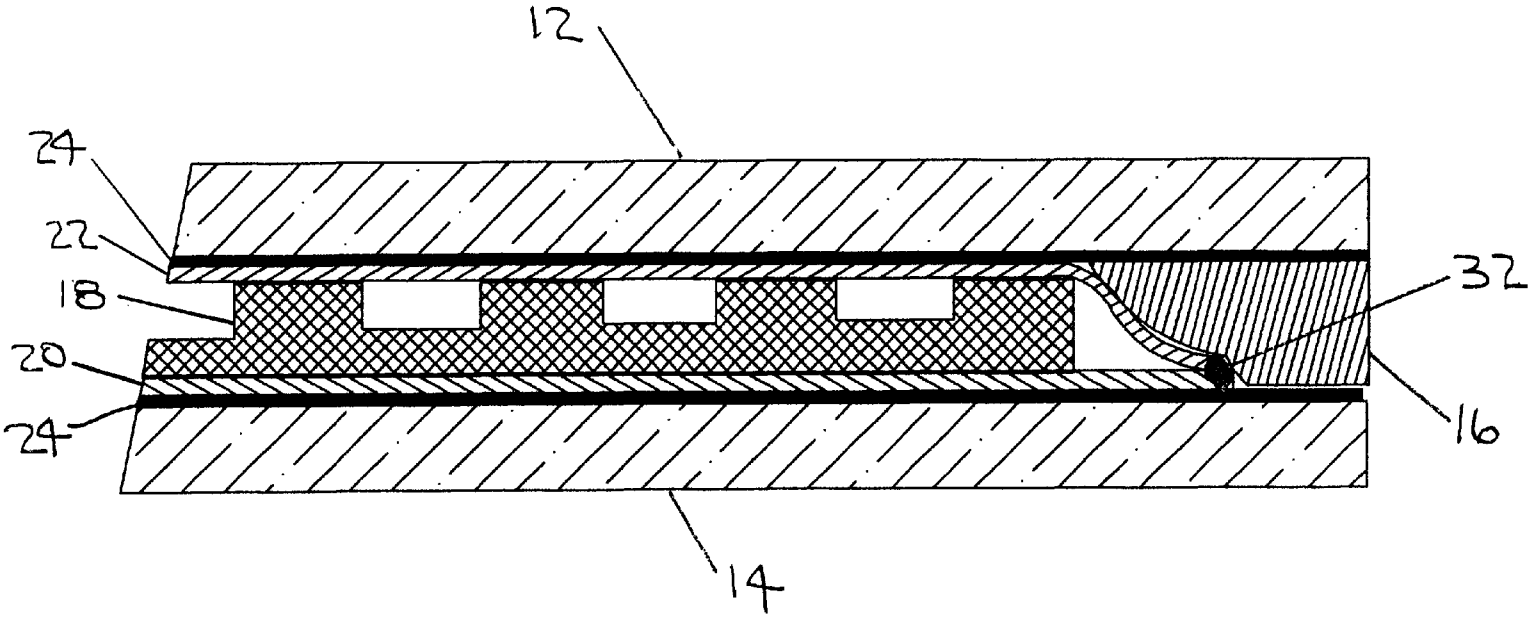
FIG. 2*a* is a partial cross-sectional view of one embodiment of my invention indicated by section lines 2—2 of FIG. 1.

FIG. 2*a* depicts a partial cross-sectional view of flat plate heat pipe invention 10 in the direction of the section arrows of FIG. 1. Sintered copper powder waffle surface wick 18 is made by sintering without compaction in a hydrogen atmosphere at 850 C. for about one half hour. Copper powder has particle size of about 0.05 to 0.1 mm diameter before sintering. The waffle surface of sintered copper powder waffle surface wick 18 is formed by sintering in a machined graphite or stainless steel mold. The wick is about 0.04 to 0.20 inch thick over-all, with the waffle grid stand-offs about 0.03 to 0.15 inch thick. The waffle grid stand-offs are about 0.06 to 0.25 inch round or square with the grooves between them about 0.04 to 0.25 inch wide. The open space formed by the grooves is about 50% to 80% of the area of the solid portion of the wick. Sintered copper powder waffle surface wick 18 may be sintered to copper foil sheet 20 or it may be simply held in place by external atmospheric pressure (internal working pressure of the heat pipe is only about 1 psi absolute pressure). The copper foil heat pipe container is made by welding copper foil pan 22 to copper foil sheet 20 around their periphery, forming a hermetic seal 32. Copper foil of copper foil sheet 20 and copper foil pan 22 is approximately 3 to 5 ounce per square foot (0.004 to 0.007 inch thick). A copper evacuation and charging tube (not shown), about 0.06 to 0.12 inch diameter, is welded, soldered or brazed in place through the side wall of copper foil pan 22 for leak checking and charging with a small amount of water, the working fluid.

The copper foil heat pipe container is bonded to evaporating surface aluminum plate 14 and condensing surface aluminum plate 12 with very thin (about 0.002 inch thick) transfer tape 24 with or without ceramic filler for improved thermal conductivity, such as 3M VHB or thermal transfer tape. Aluminum plates 12 and 14 are about 0.03 to 0.12 inch thick. The bonding process may be accomplished under vacuum to achieve full surface area bonding. Other means for mechanically and thermally joining the copper foil container to the outer heat treated aluminum plates, such as ultrasonic welding, may alternatively be used.

Final leak checking with a helium mass spectrometer leak checker and charging with an appropriate amount of pure, degassed and deioniized water may be done either before or after bonding the aluminum plates to the copper container. The water charge volume is about equal to the open interstitial spaces of the sintered copper wick. After charging with water, the fill tube is sealed by clamping and welding to produce a permanent hermetic seal.

Epoxy cement or other potting material 16 is then applied to fill the voids and provide a smooth edge around the periphery of flat plate heat pipe invention 10.

PREFERRED EMBODIMENT—OPERATION

In operation the object of the invention is to transfer heat from the warmer evaporating surface aluminum plate 14 to the cooler condensing surface aluminum plate 12 while maintaining the entire area of condensing surface aluminum plate 12 at a controlled uniform temperature. Heat is applied to evaporating surface aluminum plate 14 by means such as an electrical etched foil resistance heater. Ideally the heated area should correspond to the area of condensing surface aluminum plate 12 to be warmed, but a principal benefit of flat heat pipes is the ability to efficiently spread heat laterally while maintaining essentially a uniform temperature over the entire surface of condensing surface aluminum plate 12.

Sintered copper powder waffle surface wick 18 is saturated with pure water which fills the microscopic voids in the wick, holding the water in the wick by capillary attraction regardless of heat pipe orientation. The open region of the waffle surface is filled with water vapor only, and for temperatures below about 90 C. the vapor pressure of water is much less than one atmosphere.

When heat is added to evaporating surface aluminum plate 14, it transfers by conduction through evaporating surface aluminum plate 14, transfer tape 24, and copper foil sheet 20 to sintered copper powder waffle surface wick 18. Heat added to water in the wick causes some water to be vaporized to steam which leaves the wick and flows to any cooler region of condensing surface of copper foil pan 22 where it condenses and heats the surface by releasing its latent heat of vaporization. Heat is then transferred by conduction through copper foil pan 22, transfer tape 24, and condensing surface aluminum plate 12 to its cool surface where heat is needed. Condensed liquid water is absorbed into the wick and flows by capillary action to refill the voids left by water that has evaporated into steam.

Steam will only condense on surfaces cooler than the steam, so that heat is only applied where it is needed. A temperature measuring sensor in condensing surface aluminum plate 12 acts through a temperature controller to turn heat to evaporating surface aluminum plate 14 on and off as needed.

OTHER EMBODIMENTS

Copper Screen Spacer—Description

Figure 2B:
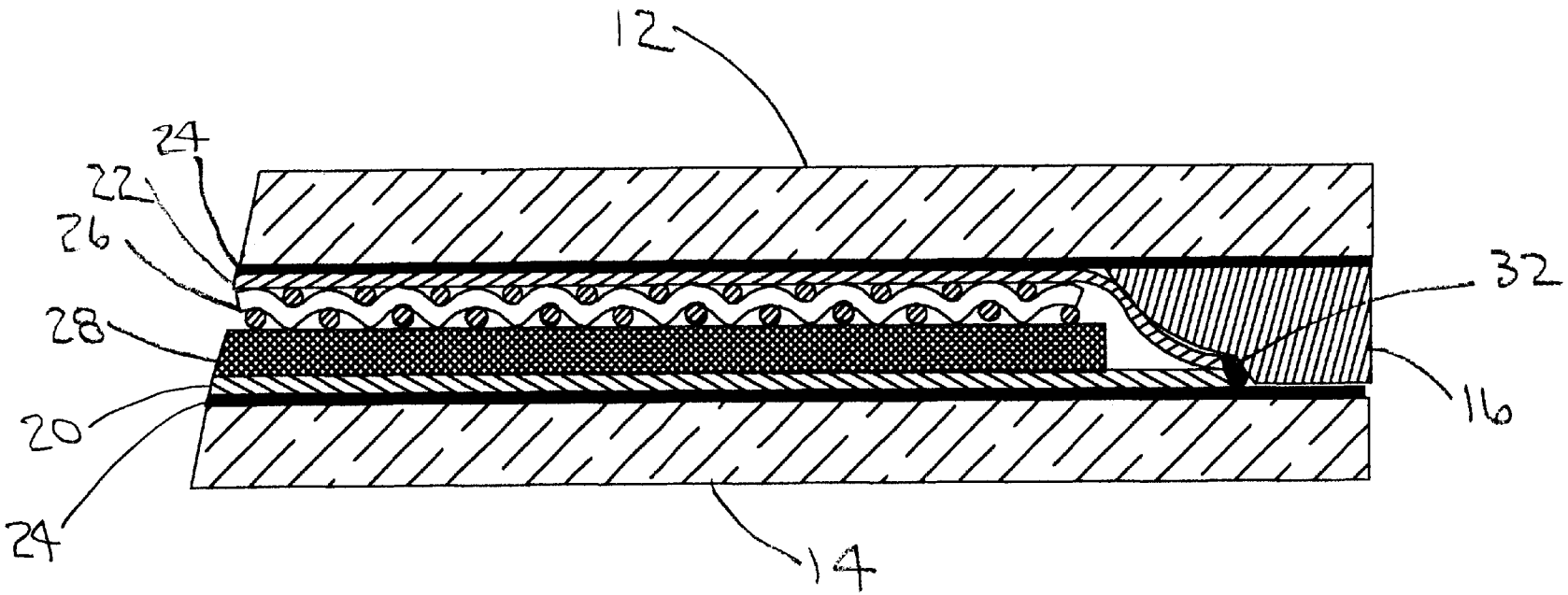
FIG. 2*b* is a partial cross-sectional view of another embodiment of my invention indicated by section lines 2—2 in FIG. 1.

FIG. 2*b* shows an alternative means for providing a relatively open region for steam to flow to cool areas of copper foil pan 22 where it condenses and warms the cool area. In this embodiment a copper screen 26 separates flat sintered wick 28 from copper foil pan 22. Copper screen 26 serves the function of waffle grid stand-offs of FIG. 2*a*. In other details, this embodiment is similar to the preferred embodiment.

Copper Screen Spacer—Operation

In operation this embodiment is similar to the preferred embodiment, except that the flow of steam from wick to condensing surface is through the open spaces between the wires of copper screen 26.

Rigid Copper Foam Spacer—Description

Figure 2C:
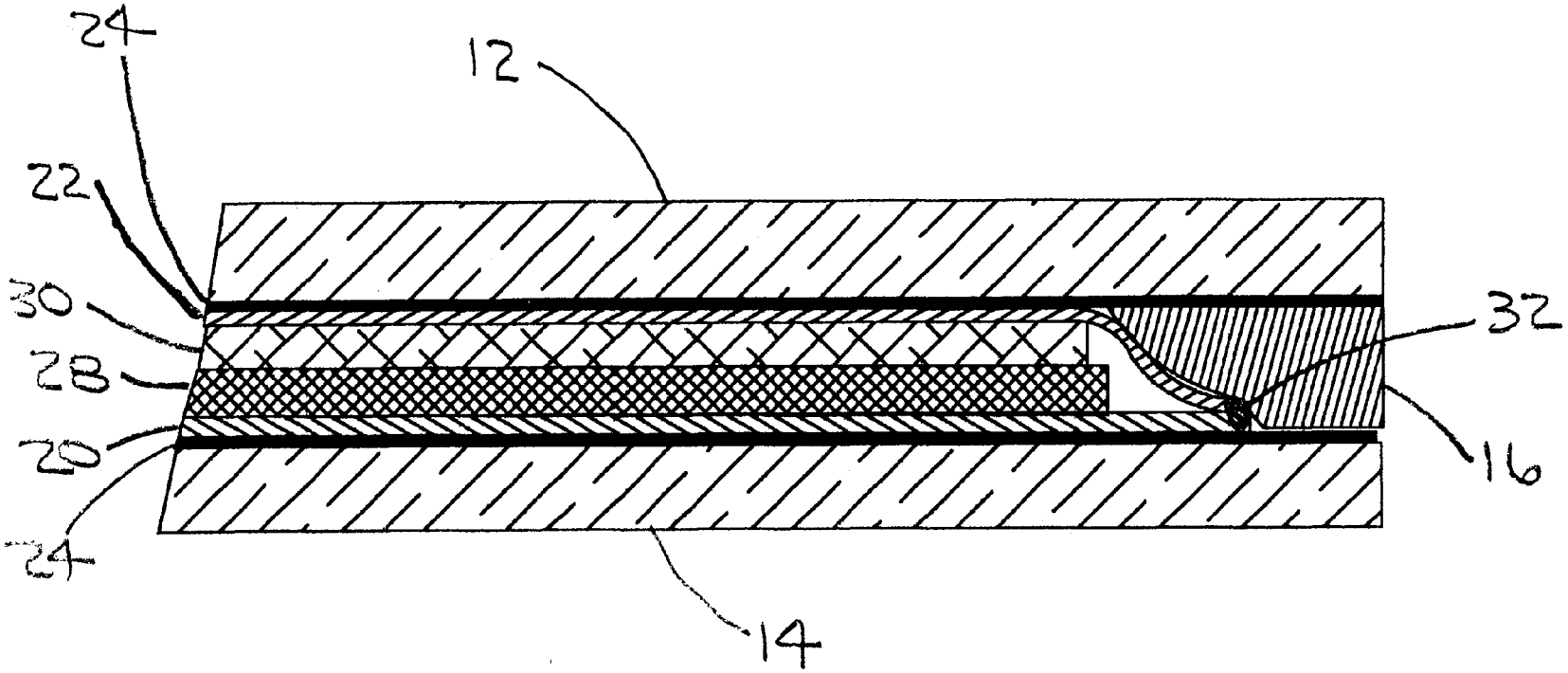
FIG. 2*c* is a partial cross-sectional view of another embodiment of my invention indicated by section lines 2—2 of FIG. 1.

FIG. 2*c* shows another alternative means of providing a relatively open region for steam flow. In this embodiment a rigid copper open cell foam sheet 30 separates flat sintered wick 28 from copper foil pan 22. Rigid copper open cell foam sheet 30 serves the function of waffle grid stand-offs of FIG. 2*a*. In other details, this embodiment is similar to the preferred embodiment.

Rigid Copper Foam Spacer—Operation

In operation this embodiment is similar to the preferred embodiment, except that steam flows from the wick through the open cells of rigid copper open cell foam sheet 30.

Conclusions, Ramifications, and Scope

Accordingly, it can be seen that the laminated flat plate heat pipe of this invention provides marked improvements over existing art by eliminating much machining of the heat pipe container, thereby reducing manufacturing cost. Heat treated aluminum plate outer layers greatly increase resistance to denting and puncture, thus producing a much more durable product. High thermal performance is preserved by maintaining very low thermal resistance through the laminations. The transfer tape adhesive is very thin, and its thermal conductivity may be enhanced by ceramic additives. Another very important benefit of this invention is the reduction in weight of about 40% compared to an all-copper flat heat pipe.

Although the description above contains many specificities, these should not be construed as limiting the scope of the invention but as merely providing illustrations of some of the presently preferred embodiments of this invention. Various other embodiments and ramifications are possible within its scope. Thus the scope of the invention should be determined by the appended claims and their legal equivalents, rather than by the examples given.

What is claimed is:

1. A flat plate heat pipe comprising:

a flat rigid plate-shaped sintered wick made of copper powder sintered together disposed to absorb and hold water by capillary attraction, said wick having at least one edge and two parallel surfaces, a waffle-shaped pattern is molded into one surface the projections of which are about 0.06 to 0.25 inch round or square and about 0.03 to 0.15 inch in height with open grooves between said projections being about 0.04 to 0.25 inch wide, whereby about 50% to 80% of said one surface area remains open for free flow of steam;

a copper-foil hermetically-sealable container having two faces extending slightly beyond the edges of said wick and joining together forming a wall to enclose said wick;

means for evacuating, leak checking, and charging said container with water, such as a copper tube passing through said wall of said container and hermetically soldered, brazed, welded or otherwise sealed through said wall;

two flat plates of highly heat conductive, mechanically strong material slightly larger in extent than said container faces, one plate placed in close contact with one surface of said container and the other plate placed in close contact with the other surface of said container; and means for thermally-conductively and mechanically attaching said flat plates to said copper-foil container, whereby a light weight, rigid, mechanically durable, low cost flat copper-water heat pipe may be produced.

2. A flat plate heat pipe comprising:

a flat plate-shaped wick for absorbing and holding water by capillary attraction, said wick having two parallel surfaces and at least one edge;

a copper-foil hermetically-sealable container made of copper foil about 0.004 to 0.008 inch thick, having two faces extending slightly beyond the edges of said wick and joining together forming a wall to enclose said wick;

means for spacing a face of said copper-foil container slightly apart from a surface of said wick while allowing free flow of steam throughout the space between the wick surface and the face of said copper-foil container;

means for evacuating, leak checking, and charging said container with water, such as a copper tube passing through said wall of said container and hermetically soldered, brazed, welded or otherwise sealed through said wail;

two flat plates of highly heat conductive, mechanically strong material slightly larger in extent than said container faces, one plate placed in close contact with one surface of said container and the other plate placed in close contact with the other surface of said container; and means for thermally-conductively and mechanically attaching said flat plates to said copper-foil container, whereby a light weight, rigid, mechanically durable, low cost flat copper-water heat pipe may be produced.

3. A flat plate heat pipe comprising:

a flat plate-shaped wick for absorbing and holding water by capillary attraction, said wick having two parallel surfaces and at least one edge;

a copper-foil hermetically-sealable container made of one flat copper foil face sheet and one pan-shaped copper foil sheet having a periphery with pan walls being equal in height to the combined thickness of said wick and a means for spacing said face sheet of copper-foil container apart from said wick surface, wherein said pan-shaped copper foil sheet has a narrow flange entirely around said periphery and parallel to the large flat area of said pan-shaped copper foil sheet, the edges of said flange corresponding in extent to the edges of said flat copper foil sheet and wherein said edges of said sheets being hermetically joined together by welding, soldering, brazing or other means to enclose said wick;

means for spacing a face of said copper-foil container slightly apart from a surface of said wick while allowing free flow of steam throughout the space between the wick surface and the face of said copper-foil container;

means for evacuating, leak checking, and charging said container with water, such as a copper tube passing through said wall of said container and hermetically soldered, brazed, welded or otherwise sealed through said wall;

two flat plates of highly heat conductive, mechanically strong material slightly larger in extent than said container faces, one plate placed in close contact with one surface of said container and the other plate placed in close contact with the other surface of said container; and means for thermally-conductively and mechanically attaching said flat plates to said copper-foil container, whereby a light weight, rigid, mechanically durable, low cost flat copper-water heat pipe may be produced.

4. A flat plate heat pipe comprising:

a flat plate-shaped wick for absorbing and holding water by capillary attraction, said wick having two parallel surfaces and at least one edge;

a copper-foil hermetically-sealable container having two faces extending slightly beyond the edges of said wick and joining together forming a wall to enclose said wick;

means for spacing a face of said copper-foil container slightly apart from a surface of said wick while allowing free flow of steam throughout the space between the wick surface and the face of said copper-foil container;

means for evacuating, leak checking, and charging said container with water, such as a copper tube passing through said wall of said container and hermetically soldered, brazed, welded or otherwise sealed through said wall;

two flat plates of highly heat conductive, mechanically strong material slightly larger in extent than said container faces, one plate placed in close contact with one surface of said container and the other plate placed in close contact with the other surface of said container; and means for thermally-conductively and mechanically attaching said flat plates to said copper-foil container, whereby a light weight, rigid, mechanically durable, low cost flat copper-water heat pipe may be produced.

5. The flat plate heat pipe of claim 4 wherein said wick is made of copper powder sintered together to form a mechanically rigid sintered wick.

6. The flat plate heat pipe of claim 5 wherein said sintered wick has on one surface a waffle-shaped pattern molded into said surface, the projections of said waffle-shaped pattern serving as said means for spacing said face of said copper-foil container apart from said wick surface.

7. The flat plate heat pipe of claim 6 wherein said projections of said waffle shaped pattern are about 0.06 to 0.25 inch round or square and about 0.03 to 0.15 inch in height with open grooves between said projections being about 0.04 to 0.25 inch wide, whereby about 50% to 80% of wick surface area remains open for free flow of steam.

8. The flat plate heat pipe of claim 5 wherein said spacing means is copper screen.

9. The flat plate heat pipe of claim 5 wherein said spacing means is rigid open cell copper foam.

10. The flat plate heat pipe of claim 4 wherein said two flat plates of highly heat conductive, mechanically strong material are made of heat treated aluminum.

11. The flat plate heat pipe of claim 4 wherein said means for thermally and mechanically attaching said flat plates to said copper-foil container is very thin transfer tape adhesive.

12. The flat plate heat pipe of claim 11 wherein said very thin transfer tape adhesive is ceramic-filled to increase thermal conductivity.

13. The flat heat pipe of claim 4 wherein said copper-foil container is made of copper foil about 0.004 to 0.008 inch thick.

14. The flat plate heat pipe of claim 4 wherein:

said copper-foil container is made of one flat copper foil sheet and one pan-shaped copper foil sheet having a periphery with pan walls being equal in height to the combined thickness of said wick and said means for spacing said face of copper-foil container apart from said wick surface;

said pan-shaped copper foil sheet has a narrow flange entirely around said periphery and parallel to the large flat area of said pan-shaped copper foil sheet, the edges of said flange corresponding in extent to the edges of said flat copper foil sheet; and said edges of said sheets being hermetically joined together by welding, soldering, brazing or other means, whereby the heat pipe container may be easily assembled.

* * * * *